US007694380B1

(12) United States Patent
Meyers

(10) Patent No.: US 7,694,380 B1
(45) Date of Patent: Apr. 13, 2010

(54) MODULAR TROWEL HANDLE

(75) Inventor: Lawrence G. Meyers, Layton, UT (US)

(73) Assignee: Beno J. Gundlach Company, Layton, UT (US)

( * ) Notice: Subject to any disclaimer, the term of this patent is extended or adjusted under 35 U.S.C. 154(b) by 1067 days.

(21) Appl. No.: 11/342,348

(22) Filed: Jan. 26, 2006

Related U.S. Application Data

(60) Provisional application No. 60/647,675, filed on Jan. 26, 2005.

(51) Int. Cl.
*E04F 21/06* (2006.01)
*B25G 1/00* (2006.01)
*B25G 1/10* (2006.01)

(52) U.S. Cl. ..... 15/235.4; 15/143.1; 15/145; 16/431; 16/436; 81/489; 81/492

(58) Field of Classification Search ..... 15/143.1, 15/145, 235.4; 16/431, 436; 81/489, 492
See application file for complete search history.

(56) References Cited

U.S. PATENT DOCUMENTS

| | | | | |
|---|---|---|---|---|
| 899,653 A | | 9/1908 | Bishop | |
| 938,070 A | | 10/1909 | Neerup | |
| 963,717 A | | 7/1910 | Linville | |
| 1,055,406 A | * | 3/1913 | Mason et al. | 15/235.4 |
| 1,544,368 A | | 6/1925 | Brennan | |
| 1,627,410 A | | 5/1927 | Rowley | |
| 3,460,183 A | | 8/1969 | Harrington | |
| 5,193,244 A | | 3/1993 | Meyers | |
| 5,327,612 A | * | 7/1994 | Kelsay | 15/235.4 |
| 5,333,348 A | | 8/1994 | Schumacher, II et al. | |
| 5,522,111 A | * | 6/1996 | Kelsay et al. | 15/235.4 |
| 6,499,178 B1 | | 12/2002 | Huang | |

* cited by examiner

*Primary Examiner*—Mark Spisich
(74) *Attorney, Agent, or Firm*—Thorpe North & Western LLP

(57) ABSTRACT

A modular trowel handle device comprises a handle section to provide a handle interface for a user of the trowel handle and a post extending from the handle section. A mounting surface is coupled to the post and extends generally parallel to the handle section. The mounting surface includes a plurality of fasteners extending therefrom or formed therein. A trowel blade receiving plate includes engaging structure configured to engage a connector of a trowel blade and a plurality of corresponding fasteners extending therefrom or formed therein. The trowel blade receiving plate is coupled to the mounting surface by the fasteners and is formed from a different material than the mounting surface.

9 Claims, 7 Drawing Sheets

MODULAR TROWEL HANDLE

Priority is claimed to U.S. Provisional Patent Application No. 60/647,675, filed Jan. 26, 2005, which is hereby incorporated herein in its entirety.

BACKGROUND OF THE INVENTION

1. Field of the Invention

The present invention relates generally to handles adapted for attachment to blades, knives, and other tools for use in spreading or applying construction materials.

2. Related Art

Trowels are used in a variety of construction applications including flooring installation, tile laying, concrete finishing, etc. As trowels are generally subject to repeated contact with abrasive surfaces or materials, the blade of the trowel is often formed from a substantially hardened blade material, such as hardened steel, to prolong a usable life of the trowel blade. Typically, such materials are formed into blades which then must have a handle attached thereto. In some applications, engagement cleats or connectors are coupled to or with the blade to allow a handle to be removably attached to the blade.

It is sometimes desired that the handle of the blade be attached to the blade in a manner that allows easy removal of the handle from the blade, to either replace the blade or to interchange the blade for another application. Thus, a removable interface is often desired between the blade and the handle. However, as the blade and handle are often used in wet environments, it is important that the handle be mated tightly with the blade to prevent water and other materials, such as adhesive, from building up between the blade and the handle. Accordingly, those who produce interchangeable handles for trowel often struggle between providing an attachment interface between the handle and the blade that allows the blade to be easily detached from the handle, and that also securely attaches the blade to handle when in use.

Also, as such trowel blades are often grasped with a user's bare hand, it is often desired to provide a soft, comfortable interface on the trowel handle upon which the user's hand is placed or grasps during use. Because materials that provide a soft, comfortable interface can be relatively easily damaged when contacted by adhesives and cured and uncured concretious materials, it has been desired to provide the trowel blade handle with a user interface that can be replaced in the event it becomes worn or damaged. One advantageous material from which to form such replaceable parts is extruded or pressed polymers, which are often hollow. In order to ensure that these polymeric parts are assembled in a manner that ensures water and/or chemicals do not enter the handle and damage the mechanisms that allow replacability, traditional handles have required very tight tolerances, which can greatly increase the cost and efficiency of such products.

SUMMARY OF THE INVENTION

It has been recognized that it would be advantageous to develop a modular trowel handle that can be used to engage a trowel blade with both a secure interface and an interface that allows the handle to be relatively easily removed from the blade. In addition, it has been found that it would be advantageous to develop a trowel blade handle that provides a relatively comfortable interface between the user's hand and that can be easily replaced when worn or damaged.

The invention provides a modular trowel handle device, including a handle section to provide a handle interface for a user of the trowel handle and a post extending from the handle section. A mounting surface can be coupled to the post and can extend generally parallel to the handle section. The mounting surface can include a plurality of fasteners extending therefrom or formed therein. A trowel blade receiving plate can include engaging structure configured to engage a connector of a trowel blade and can include a plurality of corresponding fasteners extending therefrom or formed therein. The trowel blade receiving plate can be coupled to the mounting surface by the fasteners and can be formed from a different material than the mounting surface.

In accordance with another aspect of the invention, a modular trowel handle device is provided, including a handle section to provide a handle interface for a user of the trowel handle. The handle section can include a forward abutment coupled to a post extending downwardly to a mounting surface. An inner member can be formed of a first material. An outer sleeve can be formed of a second material. The outer sleeve can be coupled about the inner member and can have a forward and a rear terminal section. At least a portion of the forward and the rear terminal sections of the outer sleeve can extend beyond a forward and a rear terminal section of the inner member. The handle section can also include an end cap. A trowel blade receiving plate can be coupled to the post and can be operable to mate with a trowel blade to attach the handle section to the trowel blade. Coupling of the end cap to the forward abutment with the outer sleeve and inner member compressed therebetween can result in the at least a portion of the forward and the rear terminal sections of the outer sleeve compressibly and sealably engaging the forward abutment and the end cap, respectively.

In accordance with another aspect of the invention, a modular trowel handle device is provided, including a handle section to provide a handle interface for a user of the trowel handle and a post extending downwardly from the handle section. A mounting surface can be coupled to the post and can extend generally parallel to the handle section. A trowel blade receiving plate can be coupled to the mounting surface and can include engaging structure configured to engage a connector of a trowel blade. The engaging structure can comprise a plurality of slots each having an opening inlet and interlock structure configured to engage a connector of a trowel blade. The interlock structure of at least some of the plurality of slots can be operable to engage a connector of the trowel blade in a different manner than does interlock structure of other of the plurality of slots.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

Reference will now be made to the exemplary embodiments illustrated, and specific language will be used herein to describe the same. It will nevertheless be understood that no limitation of the scope of the invention is thereby intended.

DETAILED DESCRIPTION

As preliminary matters, distances, forces, weights, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited.

As an illustration, a numerical range of "about 1 inch to about 5 inches" should be interpreted to include not only the explicitly recited values of about 1 inch to about 5 inches, but also include individual values and sub-ranges within the indicated range. Thus, included in this numerical range are individual values such as 2, 3, and 4 and sub-ranges such as from 1-3, from 2-4, and from 3-5, etc. This same principle applies to ranges reciting only one numerical value and should apply regardless of the breadth of the range or the characteristics being described.

Figure 1:
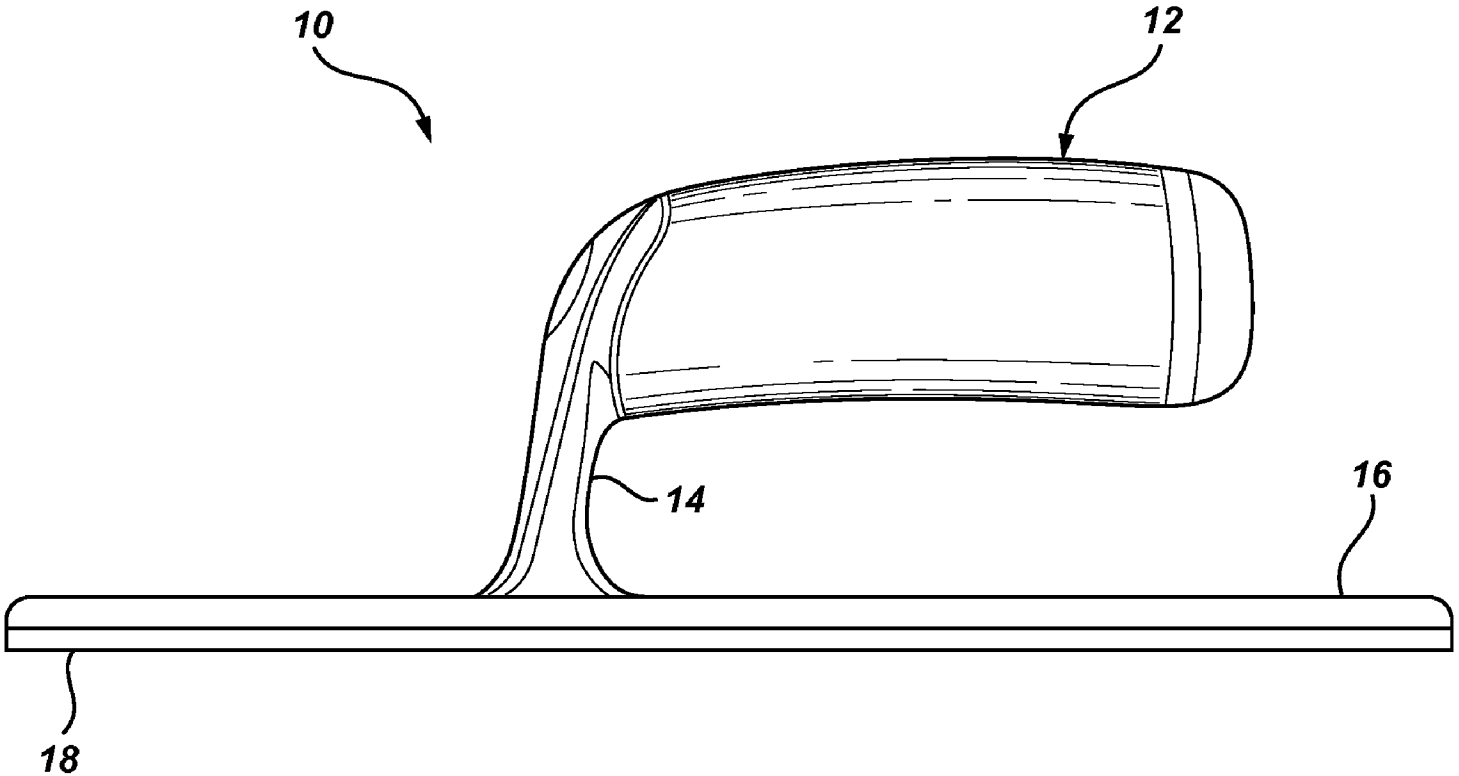
FIG. 1 is a side view of a modular trowel handle in accordance with an embodiment of the present invention.

As used herein, the relative terms "rearward," "forward," "upwardly," "downwardly," and the like are to be understood to refer to directions relative to the trowel as illustrated in FIG. 1, as the trowel device would be oriented while resting on a typical flooring surface.

As used herein, the term "irremovably" attached is to be understood to refer to a condition in which two or more components are attached to one anther in such a manner that separation of the components results in physical damage to one or more of the components. Thus, two or more components that are irremovably attached to one another cannot be separated during normal usage of the components.

As used herein the term "connector," when used in accordance with a device attached to a trowel blade in order to allow attachment of a handle to the trowel blade, is to be understood to refer to a device or feature of the trowel blade that facilitates removable attachment of a handle to the trowel blade. Suitable connectors and trowel blades are discussed in detail in U.S. Pat. No. 5,193,244, to the present inventor, for example, the connectors shown at 28B in FIGS. 11 and 15 and the blade shown at 26 in FIGS. 11 and 16 of the referenced U.S. Patent. The referenced patent, U.S. Pat. No. 5,193,244 is hereby incorporated herein by reference in its entirety to the extent it is consistent with the teachings herein.

Turning now to FIG. 1, as shown generally at 10, in one embodiment of the invention a modular trowel handle device is provided. The device can include a handle section 12 configured to provide a handle interface for a user (not shown) of the device. A post 14 can extend from the handle section in a generally downward direction. A mounting surface 16 can be coupled to the post and can extend generally parallel to the handle section.

Figure 2:
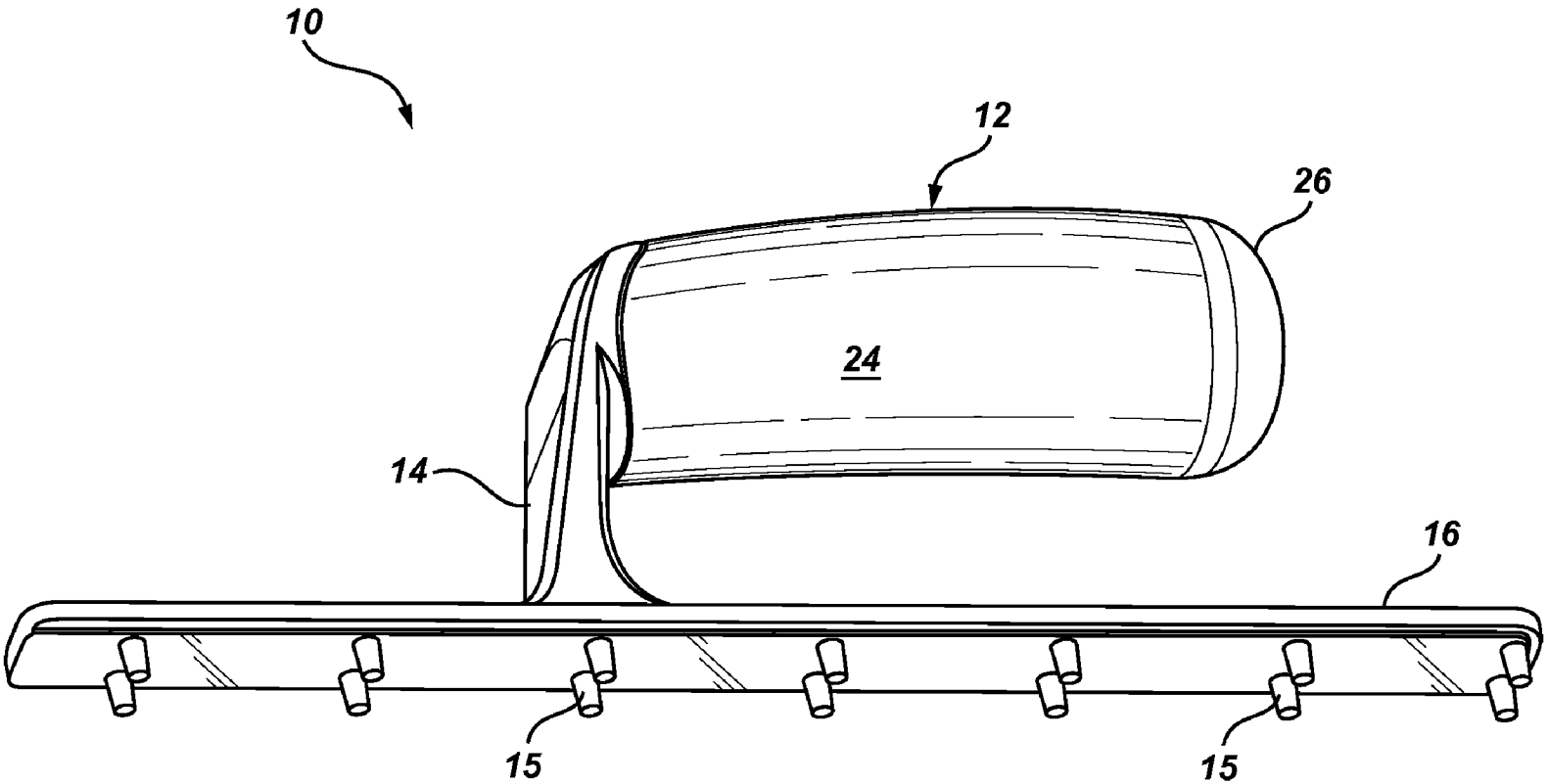
FIG. 2 is a side, bottom perspective view of the trowel handle of FIG. 1.

As shown in FIG. 2, the mounting surface 16 can include a plurality of fasteners 15 that can extend therefrom or that can be formed therein. In the embodiment illustrated in FIG. 2, the fasteners are generally cylindrical posts that extend downwardly from the mounting surface and can engage corresponding fasteners, such as cavities or holes (17 in FIGS. 5 and 6) in a trowel blade receiving plate 18. In this embodiment, the cylindrical posts are generally disposed within the cavities or holes, and are then impacted from the top of the post to cause the post to deform into and fill the cavities. In this manner, the trowel blade receiving plate is generally irremovably attached to the mounting surface to ensure that the trowel handle can be removably attached to and removed from a variety of trowel blades through the life of the trowel blade handle.

Figure 5:
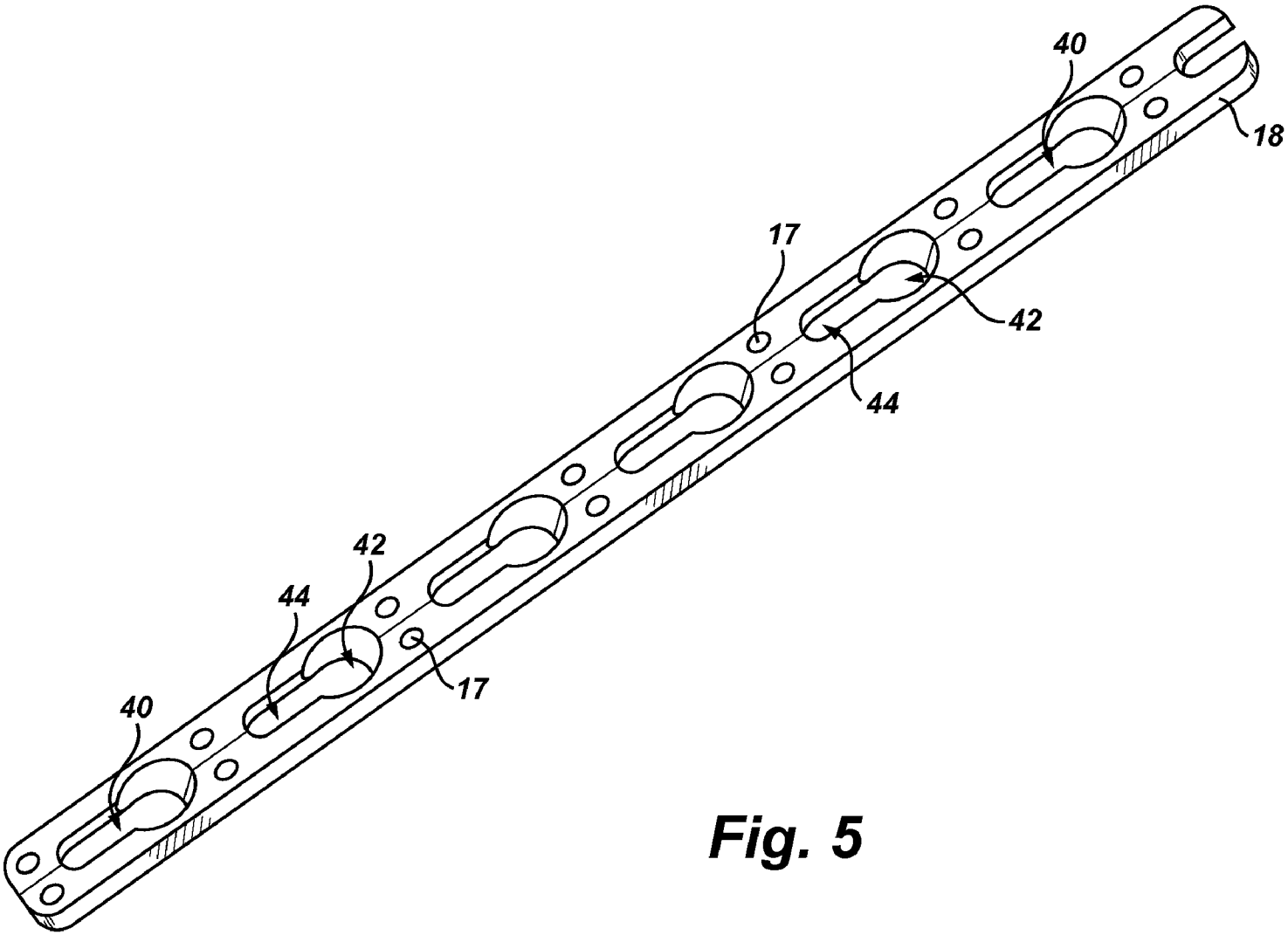
FIG. 5 is a bottom perspective view of a trowel blade receiving plate in accordance with an embodiment of the invention.
Figure 6:
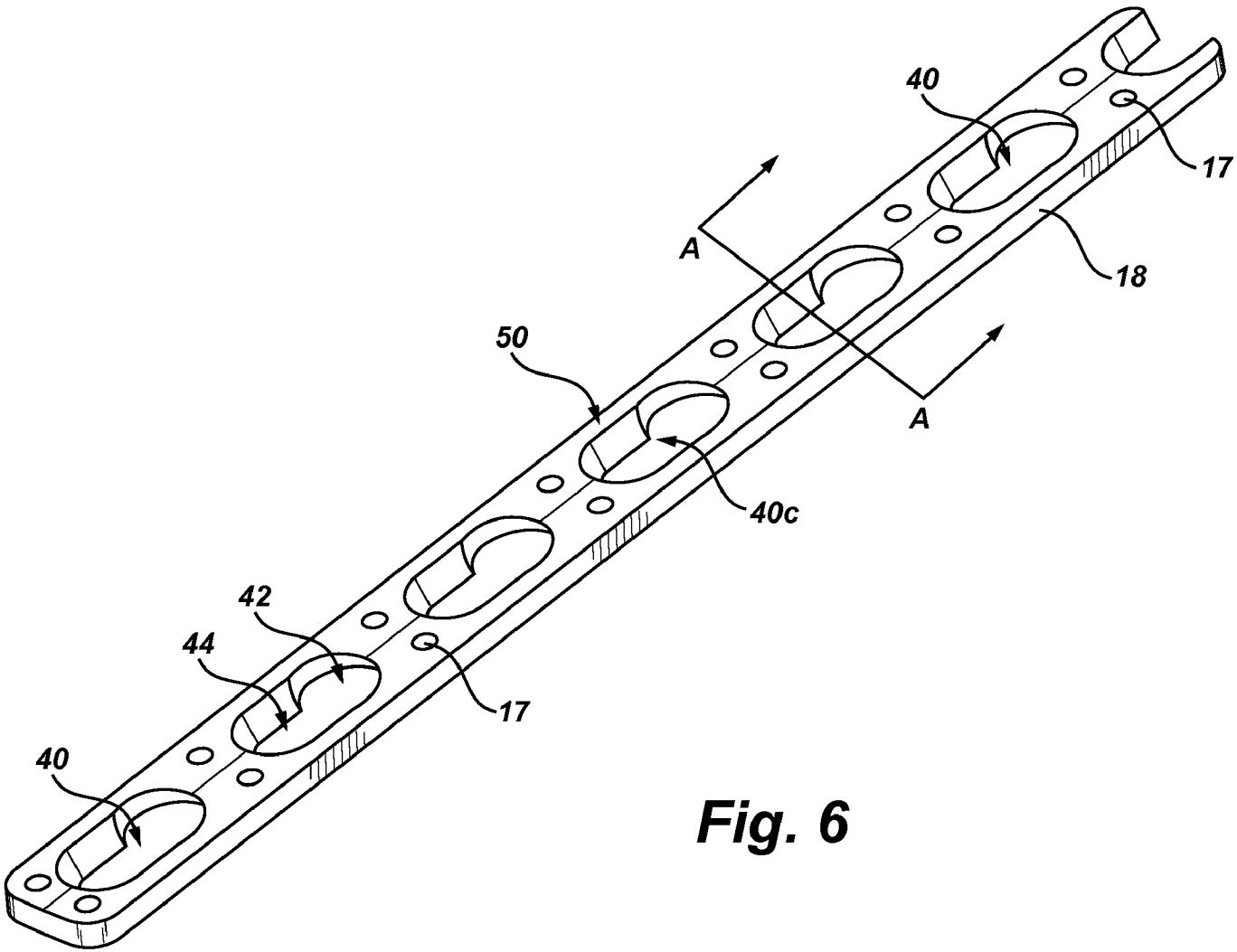
FIG. 6 is a top perspective view of the trowel blade receiving plate of FIG. 5.

The trowel blade receiving plate 18 can include engaging structure that can be configured to engage a connector of a trowel blade (not shown). The trowel blade receiving plate can be coupled to the mounting surface 16 by the fasteners and can be formed from a different material than the mounting surface. The materials from which each of the mounting surface and the trowel blade receiving plate can be formed can vary. In one embodiment, a majority of portions of the trowel handle, including the mounting surface 16, can be formed from die-cast aluminum and the trowel blade receiving plate can be formed from a zinc alloy, such as a No. 2 or No. 3 zinc alloy. The trowel blade receiving plate is shown in FIGS. 5 and 6 as being formed of two joined halves. However, it is to be understood that the trowel blade receiving plate can be formed from an integral piece of material.

Several advantages can be achieved by forming the trowel blade receiving plate 18 from a different material than the mounting surface 16. For example, as the trowel blade receiving plate can be configured to mate with the connectors of the trowel blade, the tolerance requirements for its features are often much more stringent than for the remaining structure of the handle. By using a separate material, the manufacturing processes used for the remaining structure of the handle can be selected based upon a lower tolerance regime. In addition, while die-cast aluminum is a material that has been found suitable for the handle components, die-cast aluminum is relatively difficult on tooling equipment and can only be manufactured in limited quantities for high-precision processes prior to requiring that the manufacturing tooling be replaced.

In contrast, it has been found that zinc is much less corrosive to the tooling equipment utilized and can be manufactured to relatively tight tolerances for extended cycles without requiring replacement of the tooling. While aluminum and zinc alloys are used herein as examples of suitable materials for the handle body and the trowel blade receiving plate, it is to be understood that a variety of materials can be utilized in the two sections, the choice of which can vary depending upon economic considerations, particular usages of the trowel blade handle, etc.

Figure 3:
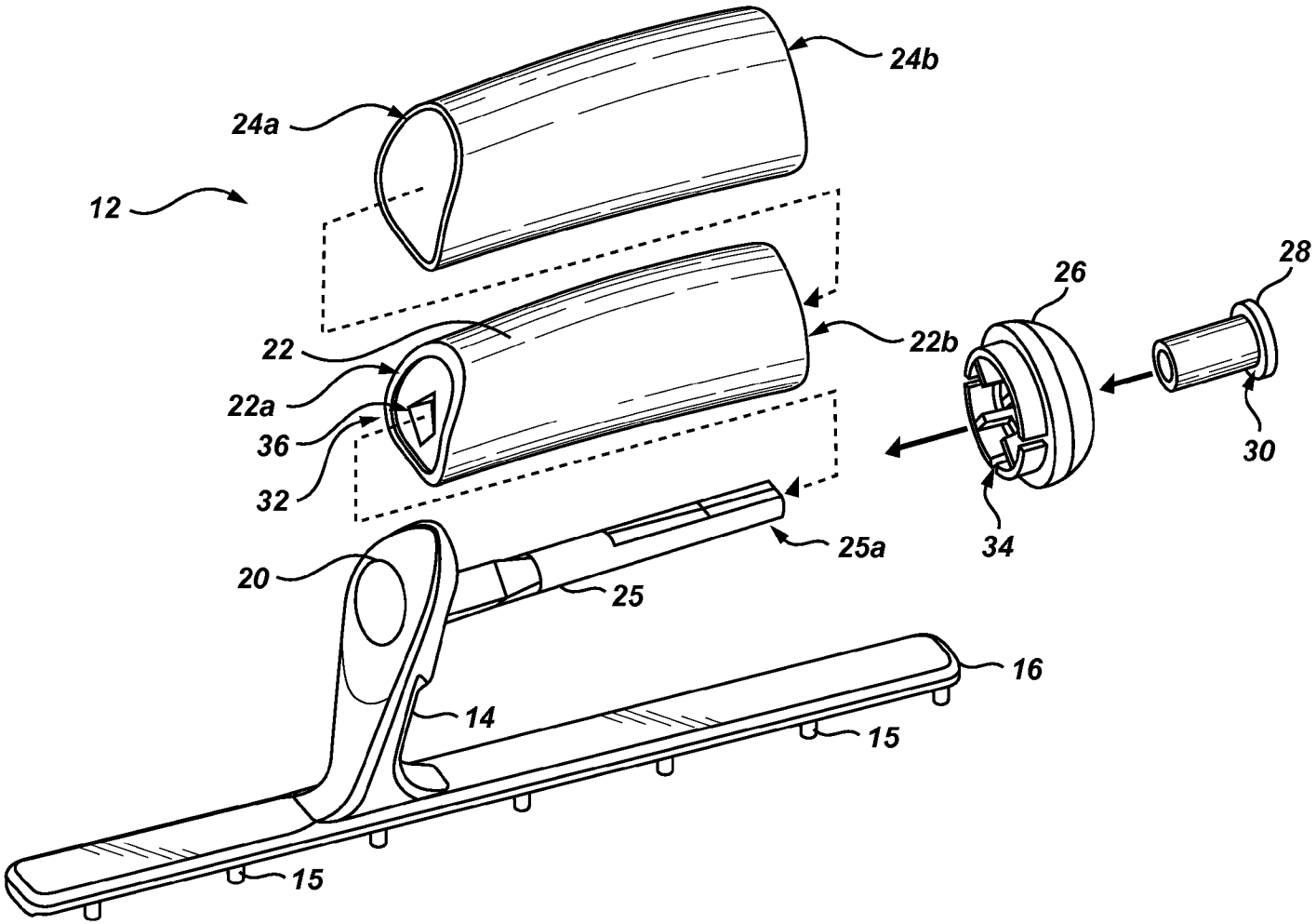
FIG. 3 is an exploded, side, top perspective view of the trowel handle of FIG. 1.
Figure 4:
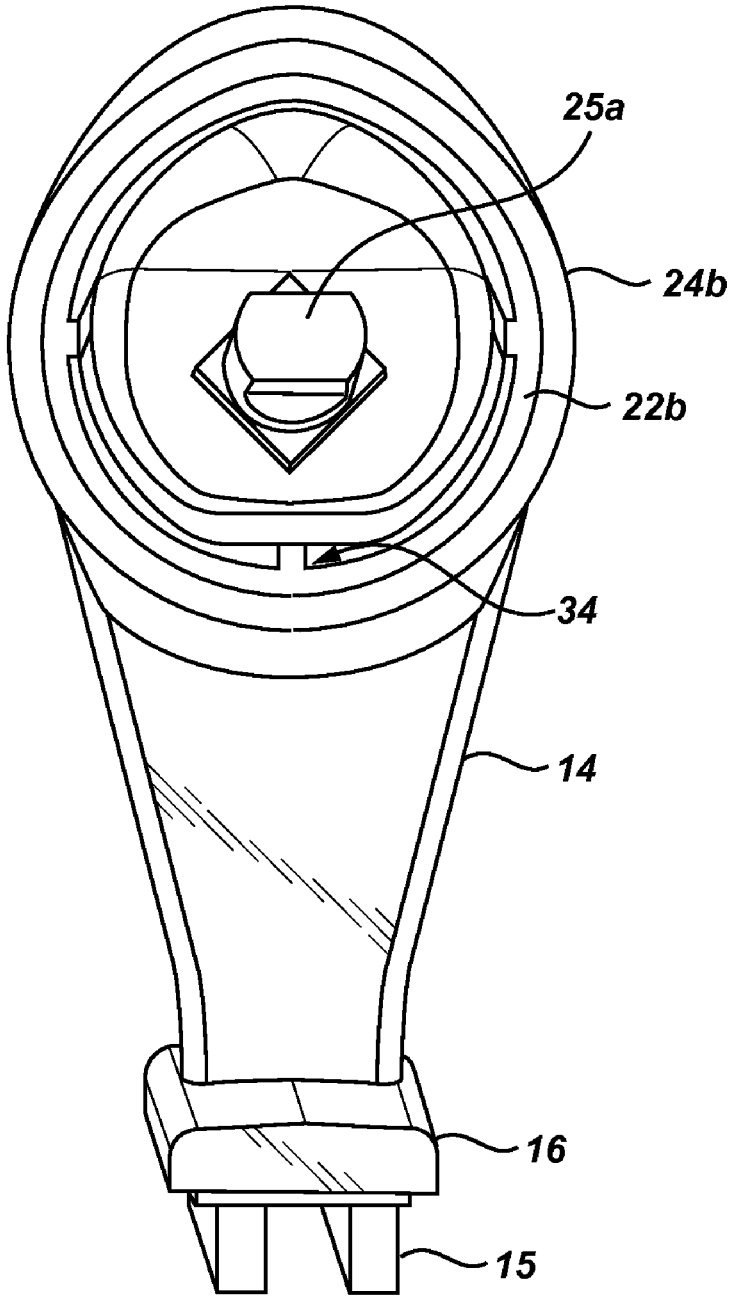
FIG. 4 is rear, end view of the trowel handle of FIG. 1, with a rear cap and connector removed therefrom.

FIG. 3 illustrates an embodiment of the modular trowel blade handle device 10 that includes the handle section 12 to provide a handle interface for a user of the trowel handle. In this aspect, the handle section can include a forward abutment 20 that can be coupled to the post 14 that extends downwardly to the mounting surface 16. The handle can include an inner member 22 that can be formed of a first material. An outer sleeve 24 can be formed of a second material and can be fit, formed, or coupled about, or molded on or around the inner member. The outer sleeve can have a forward terminal section 24*a* and a rear terminal section 24*b*. The inner member can also have a forward terminal section 22*a* and a rear terminal section 22*b*. At least a portion of the forward 24*a* and the rear 24*b* terminal sections of the outer sleeve can extend beyond the forward 22*a* and a rear 22*b* terminal section of the inner member.

A rod 25 can extend rearwardly from the forward abutment 20 and can include a rearward, threaded end 25*a*. A threaded connector or nut 28, in the embodiment shown, a barrel nut, can be configured to mate with the rearward end of the rod. An end cap 26 can be sized to mate with the inner member 22 and the outer sleeve 24. The connector nut 28 can pass through the end cap and attach to the threaded end of the rod 25. In this manner, as the connector nut is tightened onto the threaded rod, the end cap is pressed against the rear terminal sections 22*b*, 24*b*, respectively, of the inner member and the outer sleeve. Thus, the nut serves to compress the components of the handle 12 to seal the components to restrict the entry of water and other contaminants within the handle components.

While the material from which the outer sleeve 24 and the inner member 22 are formed can vary, in one embodiment the inner member is formed from a relatively stiff, but lightweight, material such as polypropylene. In this aspect of the invention, the outer sleeve can be formed from a relatively pliable, soft material such as a thermoplastic elastomer.

By extending at least a portion of the forward terminal section 24*a* and the rear terminal section 24*b* of the outer sleeve beyond the forward terminal section 22*a* and the rear terminal section 22*b* of the inner member, as the components are tightened together the portions of the outer sleeve that overhang the inner member compress, resulting in the outer sleeve compressibly and sealably engaging the forward abutment and the end cap, respectively. In this manner, a good liquid-tight seal is formed between all components of the handle, ensuring that liquid or adhesives cannot enter the internal portions of the handle.

A gasket 30 can be disposed on the threaded connector 28 to ensure a tight seal is created between the threaded connector and the end cap 26. The gasket 30 can also aid in creating a frictional interface between the connector 28 and the end cap. The frictional interface can aid in retaining the nut in position relative to the cap without requiring a great deal of force be applied by the operator when assembling the handle. A rearward portion of the connector 28 can include one or more slots that can be engaged with a screwdriver, coin, or equivalent structure when assembling or disassembling the trowel handle. In this manner, components of the trowel handle can be changed by an operator while in the field without requiring specialized tools such as wrenches and the like. While the gasket is shown generally as an O-ring type gasket, it can also be shaped as a "washer"-type gasket and other types of gaskets known to those of ordinary skill in the art.

In the embodiment shown, the forward 24*a* and rear 24*b* terminal sections of the outer sleeve 24 extend substantially completely around an outer perimeter of the outer sleeve. That is, each location about the perimeter of the outer sleeve overhangs a corresponding location about the perimeter of the inner member. In other embodiments, only a portion of the perimeter of the outer sleeve need overhang a corresponding portion of the perimeter of the inner member. The amount, or distance, that the forward and rear terminal sections of the outer sleeve extend beyond the forward and rear terminal sections of the inner member can also vary. In one embodiment, the overhang sections are about ⅙ of an average thickness of the outer sleeve, on the order of about 0.015 to 0.020 inches.

A forward section 32 of the inner member 22 can include engaging structure, including the contoured shape of the forward section and/or the generally square engagement hole 36 through which rod 25 is disposed, to limit rotation of the inner member relative to the handle section. Similarly, the end cap 26 can include engaging structure, such as the contoured shape of the end cap and/or notches 34, to limit rotation of the end cap relative to the inner member.

In one aspect of the invention, a modular trowel handle device is provided that includes a handle section 12 to provide a handle interface for a user of the trowel handle, a post 14 extending downwardly from the handle section, and a mounting surface 16 coupled to the post and extending generally parallel to the handle section. A trowel blade receiving plate 18 can be coupled to the mounting surface and can include engaging structure configured to engage a connector of a trowel blade. As shown generally in FIGS. 5 and 6, the engaging structure can include a plurality of slots 40 that can each having an opening inlet 42 and interlock structure 44.

Figure 8:
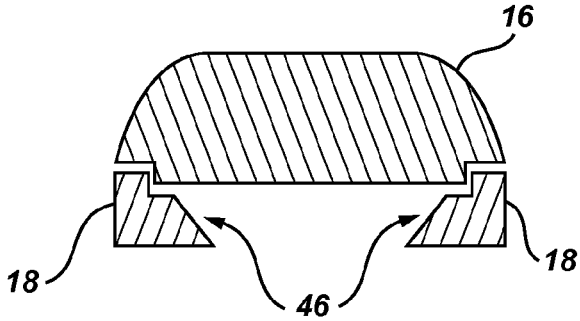
FIG. 8 is a sectional end view of a trowel blade receiving plate and a mounting surface in accordance with an embodiment of the invention, taken along section A-A of FIG. 6 (mounting surface 16 has been added to FIG. 8 for clarity, it is not shown in FIG. 6).

As best seen in FIG. 8, the interlock structure can include two generally tapering sides 46 that are configured to engage a generally cone-shaped connector of a trowel blade (not shown: the reader is directed to U.S. Pat. No. 5,193,244 for a detailed discussion of such connectors and the trowel blades to which they can be coupled). The interlock structure of at least some of the plurality of slots can be operable to engage a connector of the trowel blade in a different manner than does interlock structure of other of the plurality of slots. That is, some of the interlock structure can engage connectors of the trowel blade in one manner, while other of the interlock structure can engage connectors of the trowel blade in another manner.

Figure 7:
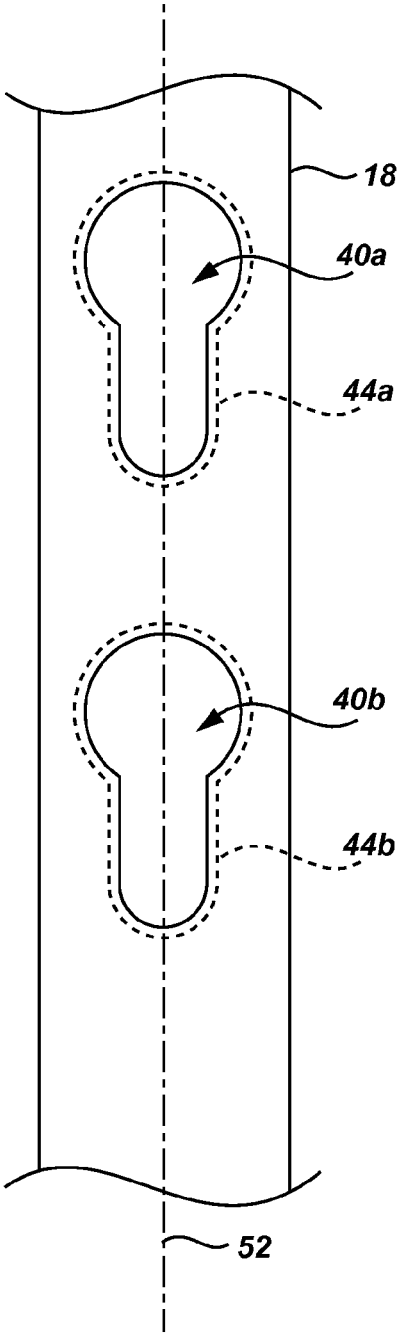
FIG. 7 is a partial, bottom view of a trowel blade receiving plate in accordance with an embodiment of the invention.

In one embodiment of the invention, the different manner of engaging connectors of a trowel blade is accomplished by providing interlock structure that varies in lateral tolerance from one slot to another. This concept is illustrated in FIG. 7, where slot 40*a* includes interlock structure 44*a* that is relatively narrower on the leftmost side of the interlock structure and relatively wider on the rightmost side of the structure.

In general, a series of cone-shaped connectors on a conventional trowel blade are generally attached along a centerline of the trowel, in linear alignment one with another (the centerline of the trowel will generally correspond with centerline 52 of the trowel blade receiving plate 18). When using the present invention with such an arrangement, as slot 40*a* engages a connector, the leftmost side (relative to the orientation in FIG. 7) will tightly engage the connector while the rightmost side (relative to the orientation in FIG. 7) will engage the connector (if it engages the connector at all) in a much less aggressive relationship. This relationship will be reversed with slot 40*b*, where the rightmost side of engagement structure 44*b* will engage more aggressively than will the leftmost side.

The present inventor has found that, by arranging the slots along the trowel blade receiving plate with alternately loose and tight tolerances on the sides of the engaging structure 44 of the slots 40, the overall tolerance requirements when forming the trowel blade receiving plate can be reduced considerably. In this manner, the manufacturing costs and time constraints associated with each handle can be reduced, providing a trowel blade handle that is less expensive to produce. In addition, the present inventor has found that the alternating arrangement of laterally variant tolerances results in a comparable coupling interface between the handle and the blade, as compared to conventional methods. Thus, a higher quality blade and handle combination can be provided with the present invention.

The difference between lateral tolerances or clearances can vary depending upon the type of connector coupled to the trowel blade and the type of materials utilized in the connectors, trowel blade and trowel blade receiving plate. However, in one embodiment of the invention, the less restrictive tolerance (e.g., the rightmost side of interlock structure 44*a* in FIG. 7) can be on the order of 0.010 inches further from the centerline of the trowel blade receiving plate 18 than is the leftmost side.

In addition to the laterally variable tolerances of the interlock structure 44, in one embodiment of the invention a trowel blade (not shown) is provided that includes a series of connectors attached thereto with at least some of the connectors being attached to the trowel blade on an axis laterally offset from a longitudinal centerline of the trowel blade. Thus, in this embodiment, the connectors on the trowel blade are offset from one to the next in series along the centerline of the trowel blade in order to provide the alternating difference in tolerance or fit from one engagement slot to another.

In one aspect of the invention, shown best in FIG. 6, at least one of the plurality of slots 40*c* can include an engagement nub 50 that can be configured to engage and removably lock a corresponding connector within the at least one slot. The engagement nub can serve as a detent to prevent the blade from beginning to slide relative to the handle after being attached to the handle and possibly becoming inadvertently detached from the handle.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited by the disclosure herein.

The invention claimed is:

1. A modular trowel handle device, comprising:

a handle section to provide a handle interface for a user of the trowel handle, the handle section including:

a forward abutment coupled to a post extending downwardly to a mounting surface;

an inner member formed of a first material;

an outer sleeve formed of a second material, the outer sleeve being coupled about the inner member and having a forward and a rear terminal section, at least a portion of the forward and the rear terminal sections of the outer sleeve extending beyond a forward and a rear terminal section of the inner member; and an end cap; and a trowel blade receiving plate, coupled to the post and being operable to mate with a trowel blade to attach the handle section to the trowel blade; wherein coupling of the end cap to the forward abutment with the outer sleeve and inner member compressed therebetween results in the at least a portion of the forward and the rear terminal sections of the outer sleeve compressibly and sealably engaging the forward abutment and the end cap, respectively.

2. The device of claim 1, wherein the first material includes polypropylene and wherein the second material includes a thermoplastic elastomer.

3. The device of claim 1, further comprising a rod extending rearwardly from the forward abutment, the rod having a rearward, threaded end and further comprising a threaded connector configured to mate with the rearward end of the rod through the end cap to compress the inner member and the outer sleeve between the end cap and the forward abutment.

4. The device of claim 3, further comprising a gasket disposed on the threaded connector, the gasket being configured to create a seal between the threaded connector and the end cap.

5. The device of claim 1, wherein the forward and rear terminal sections of the outer sleeve extend substantially completely around an outer perimeter of the outer sleeve.

6. The device of claim 1, wherein the forward and rear terminal sections of the outer sleeve extend only partially around an outer perimeter of the outer sleeve.

7. The device of claim 1, wherein the forward and rear terminal sections of the outer sleeve extend beyond the forward and rear terminal sections of the inner member by at least about ⅙ of an average thickness of the outer sleeve.

8. The device of claim 1, wherein a forward section of the inner member includes engaging structure configured to limit rotation of the inner member relative to the handle section.

9. The device of claim 1, wherein the end cap includes engaging structure configured to limit rotation of the end cap relative to the inner member.

* * * * *